US006712006B2

(12) United States Patent
Clark et al.

(10) Patent No.: US 6,712,006 B2
(45) Date of Patent: Mar. 30, 2004

(54) CENTER BEAM CAR WITH INCREASED LOAD CAPACITY

(75) Inventors: James Stephen Clark, St. John, IN (US); Theodore E. Dancu, Flossmor, IL (US); Robert J. Recupido, Frankfort, IL (US); Ray Richter, deceased, late of Aurora, OR (US); by Kim McDowell, legal representative, Tualatin, OR (US)

(73) Assignee: TRN Business Trust, Dallas, TX (US)

( * ) Notice: Subject to any disclaimer, the term of this patent is extended or adjusted under 35 U.S.C. 154(b) by 0 days.

(21) Appl. No.: 10/260,322

(22) Filed: Sep. 30, 2002

(65) Prior Publication Data

US 2003/0075072 A1 Apr. 24, 2003

(Under 37 CFR 1.47)

Related U.S. Application Data

(62) Division of application No. 09/635,978, filed on Aug. 9, 2000, now Pat. No. 6,470,808.
(60) Provisional application No. 60/147,849, filed on Aug. 9, 1999.

(51) Int. Cl.[7] ..... B61D 17/00
(52) U.S. Cl. ..... 105/355; 410/97
(58) Field of Search ..... 105/355, 404, 105/407, 416; 410/96, 97, 98, 99, 100, 103, 104, 120, 105

(56) References Cited

U.S. PATENT DOCUMENTS 3,159,112 A 12/1964 Tomlinson
3,173,645 A * 3/1965 Gray ..... 410/99
3,212,457 A * 10/1965 Looker ..... 410/105
3,244,120 A 4/1966 Taylor
3,485,184 A 12/1969 Berry
3,734,031 A 5/1973 Wagner
4,543,887 A 10/1985 Baker
4,802,420 A 2/1989 Butcher et al.
4,951,575 A 8/1990 Dominguez et al.
5,024,567 A 6/1991 Dominguez et al.
5,271,336 A 12/1993 Willetts
5,460,465 A * 10/1995 Little ..... 410/100
5,584,623 A * 12/1996 Nadherny ..... 410/99
5,758,584 A 6/1998 Saxton
5,899,646 A * 5/1999 Tatina et al. ..... 410/100
6,015,250 A * 1/2000 Walsh et al. ..... 410/100
6,199,486 B1 3/2001 Landrum et al.
6,283,700 B1 * 9/2001 Oltrogge ..... 414/607

* cited by examiner

*Primary Examiner*—Mark T. Le
(74) *Attorney, Agent, or Firm*—Fitch, Even, Tabin & Flannery

(57) ABSTRACT

A center beam railcar that has increased volume capacity and versatility. The car preferably has a narrow top chord that does not interfere with loading by overhead crane, but still contributes significantly to the strength and load carrying capacity of the railcar. The lading is preferably secured by straps, each having a first end secured on a first side of the car, and a second end secured on the opposite side of the car. The strap may extends over or under the top chord. In the preferred embodiment of the invention, the straps may be secured at or near the side sills on both sides of the car. Winches may be provided only on one side, with a simple retaining mechanism for securing a strap end provided on the other side.

5 Claims, 7 Drawing Sheets

CENTER BEAM CAR WITH INCREASED LOAD CAPACITY

This is a division of prior application Ser. No. 09/635,978, filed Aug. 9, 2000, now U.S. Pat. No. 6,670,808, which is hereby incorporated herein by reference in its entirely.

This application claims the benefit of the provisional application of the same title, filed Aug. 9, 1999, Application No. 60/147,849, the disclosure of which is incorporated by reference.

BACKGROUND OF THE INVENTION

The invention relates generally to railcars, and more particularly, to a center beam car.

Center beam cars have proven to be useful in transportation of various materials, including bulk materials such as lumber products which are of high volume and low density. However, there remains room for improvement in certain areas.

First, the usable volume capacity of the center beam car is often reached before the car's weight capacity is reached. This results in inefficiency, in that the weight carrying capacity of the car is not fully utilized. One of the objects of the invention is to provide a center beam car having capacity to carry loads of increased volume.

Another area for improvement relates to efficiency in loading and unloading the cars. While center beam cars can be loaded and unloaded efficiently with forklifts, loading and unloading by overhead crane is difficult due to the fact that the top chord typically overhangs the load. It is a general object of the invention to provide a center beam car which can be more easily loaded by overhead crane.

A further area for improvement concerns securing loads in place. After a car has been loaded, to secure the load in place, workers have generally been required to climb onto the load to secure cables to the center beam. Winches have been provided on each side of the car, fixed to the side sills at predetermined intervals. Cables are pulled from the winches to the center beam to secure the load. Later, when the car is to be unloaded, workers must again climb onto the car and release the cable ends from the center beams. The need for workers to climb onto the car after loading and prior to unloading adds time and expense to the loading and unloading operations. Application of the cables is further complicated by the fact that it has generally been necessary to employ corner protectors at the upper corners of the lading to protect the lading from damage by the cables. Application and removal of corner protection adds further time and expense to the loading and unloading operations.

SUMMARY OF THE INVENTION

The invention provides a center beam railcar that addresses the above concerns without unduly increasing the weight or expense of manufacturing the car. The railcar of the inventor preferably provides increased volume capacity and can be loaded and unloaded by overhead crane. The car also preferably provides an improved system for securing loads.

Preferably, the center beam car of the invention has sufficient volume capacity to enable the full weight capacity of the car to be utilized with certain loads. Thus, the car can "gross out" and "cube out" at the same time with, e.g., kiln-dried lumber products.

In contrast with the top chords that have been used in center beam railcars in the past, wherein the top chord is significantly wider than the intermediate portion of the center beam below the top chord, the preferred center beam railcar has a narrow top chord that does not interfere with loading by overhead crane, but still contributes significantly to the strength and load carrying capacity of the railcar. The top chord is preferably of a generally rectangular, tubular configuration, and has a width substantially equal to or slightly less than the width of the intermediate portion of the center beam therebelow. This permits the load to be stacked alongside the top chord, increasing the volume of lading that can be accommodated as compared with earlier center beam cars in which the lading generally could be stacked only as high as the bottom of the top chord. The top chord preferably is at a height slightly above the upper ends of the bulkheads.

To further increase the volume of lading that can be carried, the railcar preferably has a depressed central portion. In combination with the narrow top chord, this preferably provides a clear loading height of at least about 14 feet above the depressed central portion. The depressed central portion is located between a pair of higher end portions, each preferably having a length about equal to the length of products to be carried thereon, or a multiple thereof. In one particular embodiment, the length is about 16 feet. The depth of the depression is similarly selected to accommodate products to be carried thereon in a manner that facilitates flexibility in loading products of various sizes. In one embodiment, the depth is 16 in., to enable the depression to accommodate bundles of engineered wood products having a height of 15½ in., with the tops of the bundles being at about the same level as the adjacent end portions of the deck.

To increase versatility in securing the lading on the railcar, the lading is preferably secured by straps, each having a first end secured on a first side of the railcar, and a second end secured on the opposite side of the railcar, with the strap extending over the top chord for materials that are stacked up to the top chord, and with the strap extending under the top chord for materials which are not stacked as high.

In the preferred embodiment of the invention, the straps are secured at or near the side sills on both sides of the car, thus avoiding the need for workers to climb onto the deck or onto the load to secure the load. This also eliminates the need to provide winches on both sides of the car. Winches may be provided only on one side, with a simple mechanism for securing a strap end provided on the other side. Furthermore, to increase versatility, the winches and mechanisms that are used to retain the ends of the straps preferably are longitudinally adjustable in tracks on the side of the railcar.

The straps may be passed over the lading from one side of the car to the other by coiling a portion of the strap containing a free end, while leaving the other end attached to a winch, and manually tossing the coiled strap portion from one side of the car to the other. This may be efficiently accomplished by a worker standing with his or her back to the railcar, tossing the coiled strap over his or her shoulder.

At its ends, the center beam may include one or more elongated supports that connect the bulkheads to one or more posts. The supports need not be connected to the center sill or to the top chord.

DETAILED DESCRIPTION OF PREFERRED EMBODIMENTS

Figure 13:
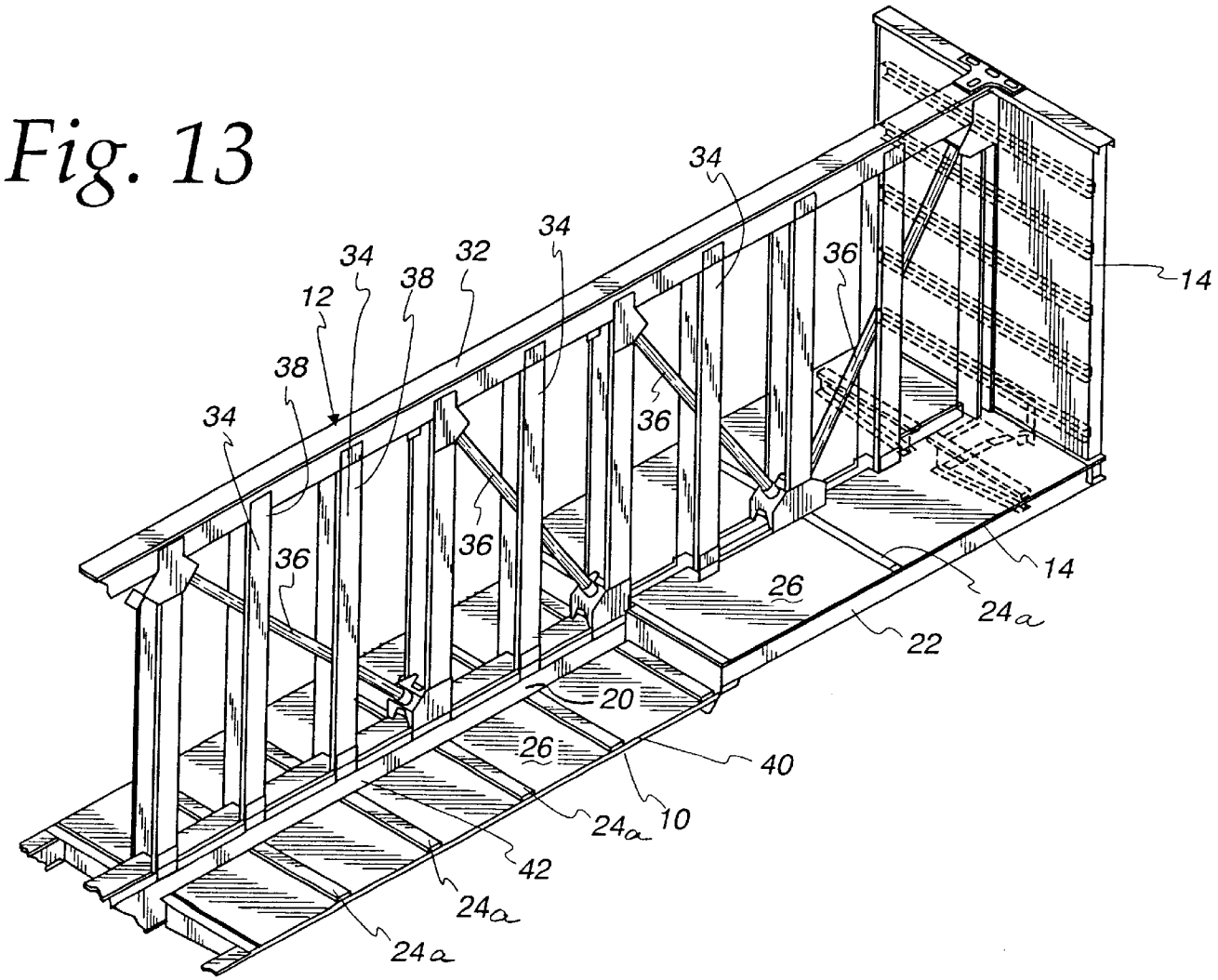
FIG. 13 is an oblique view of the embodiment of FIGS. 9–12.

The invention is preferably embodied in a center beam car for transportation of lumber products or other bulky loads comprising a deck 10 for supporting the load, a center beam 12 extending longitudinally of the railcar, and a pair of bulkheads 14, one at each end of the car, to constrain the lading against longitudinal displacement. The car is supported by a pair of trucks 16 and bolsters 18 near its opposite ends. The deck is supported by a center sill 20, a pair of side sills 22, and a plurality of cross-bearers and/or cross-ties 24. The deck may comprise floor sheets 26, which are preferably inclined inward toward the center beam, but which may be horizontal. To facilitate loading and unloading of certain loads, in some embodiments risers 24*a* (FIG. 13) may project above the top surface of the floor sheets. Stringers may be attached to the bottom of the floor sheets to stiffen them. The sides 28 of the center beam above the deck preferably are substantially perpendicular to the deck surfaces that support the lading, and accordingly are preferably either vertical or inclined slightly inward, depending upon the orientation of the load-supporting surface. Straps 52 or cables and winches 30 are preferably provided to secure the lading. The floor sheets 26 may be welded to the center sill 20, side sills 22 and cross bearers 24, or may be welded to the center beam and cross bearers only. In the latter case, the outer edges of the floor sheets may be bent down between the cross bearers to provide additional stiffness, or the outer edges may be supported by stringers.

Figure 3:
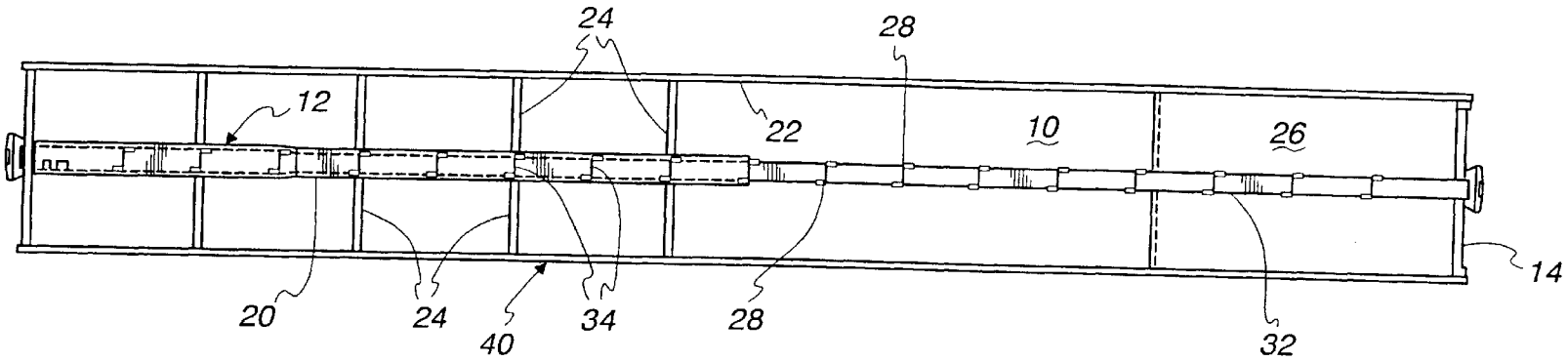
FIG. 3 is a schematic plan view of the railcar of FIG. 1 with portions omitted for clarity, showing the center sill and cross bearers on the left half, and showing the top chord and floor sheets on the right half.
Figure 4:
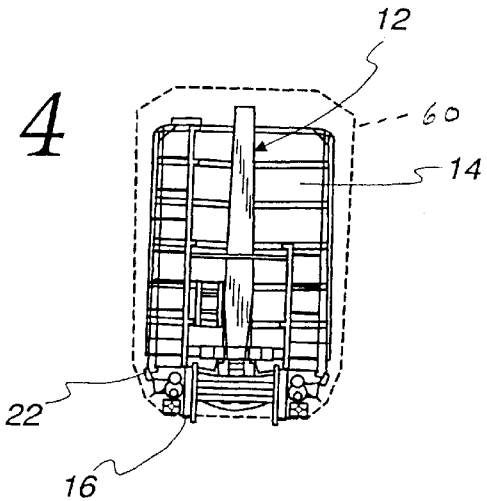
FIG. 4 is a schematic end elevational view of the railcar of FIG. 1.
Figure 7:
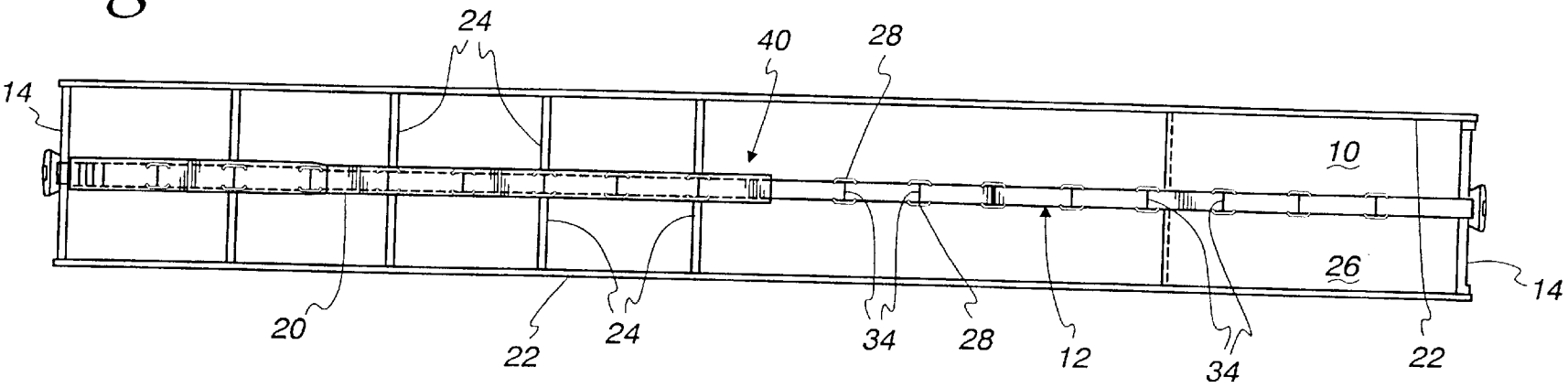
FIG. 7 is a plan view of the railcar of FIG. 5, with portions omitted for clarity.
Figure 8:
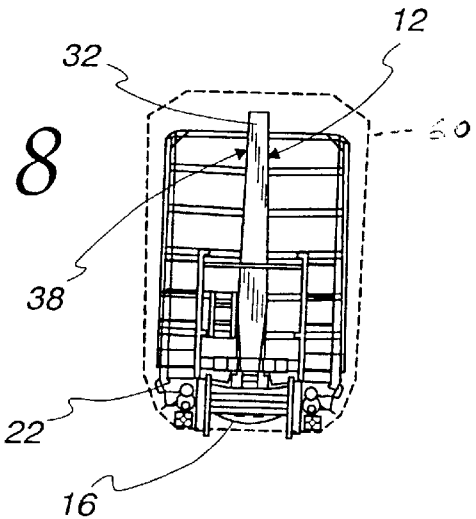
FIG. 8 is a schematic end elevational view of the railcar of FIG. 5.
Figure 9:
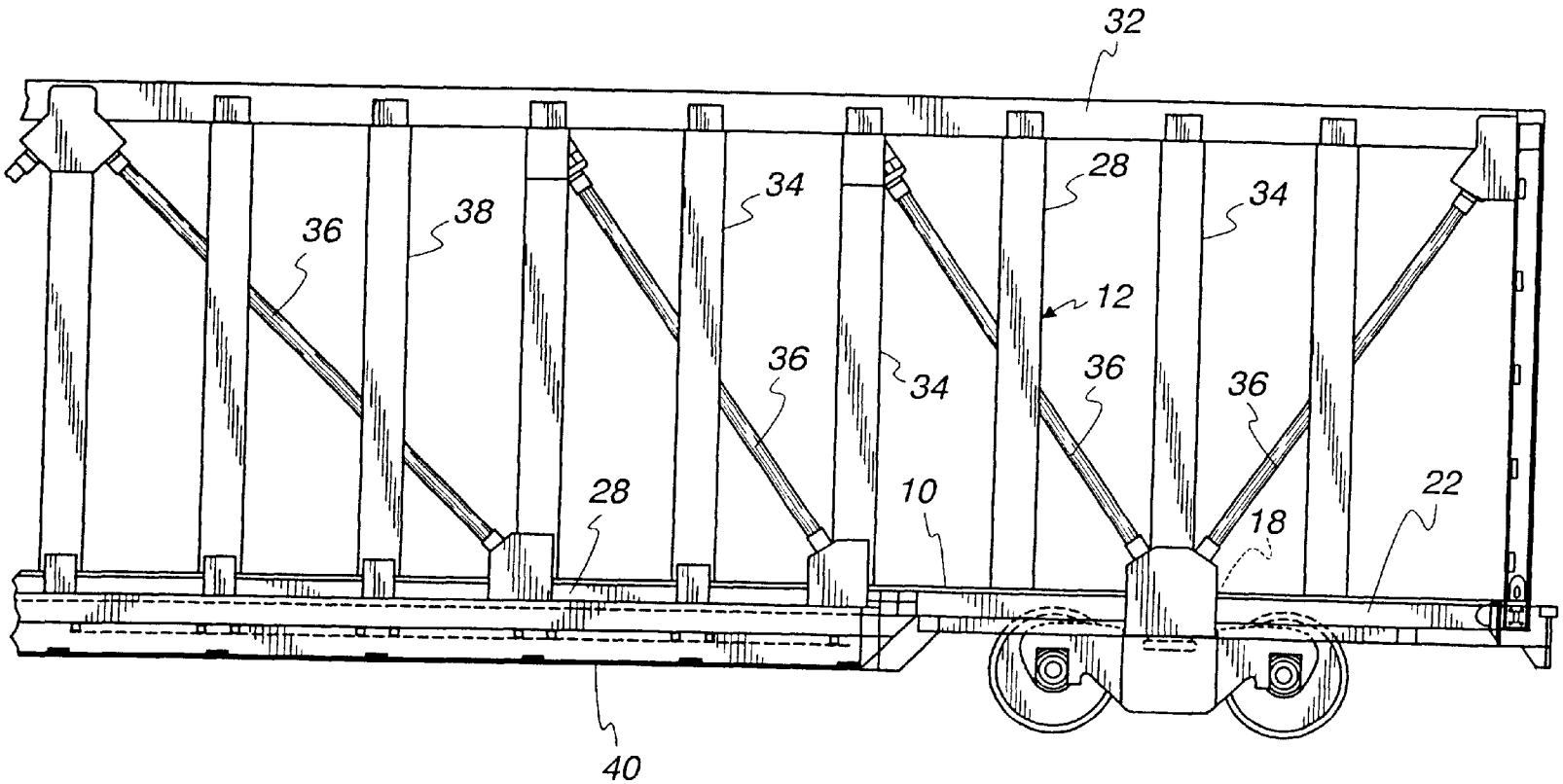
FIG. 9 is a partial side elevational view illustrating a third embodiment of the invention which is similar to the embodiments of FIGS. 5–8, except for the configuration of the ends of the center beam.
Figure 10:
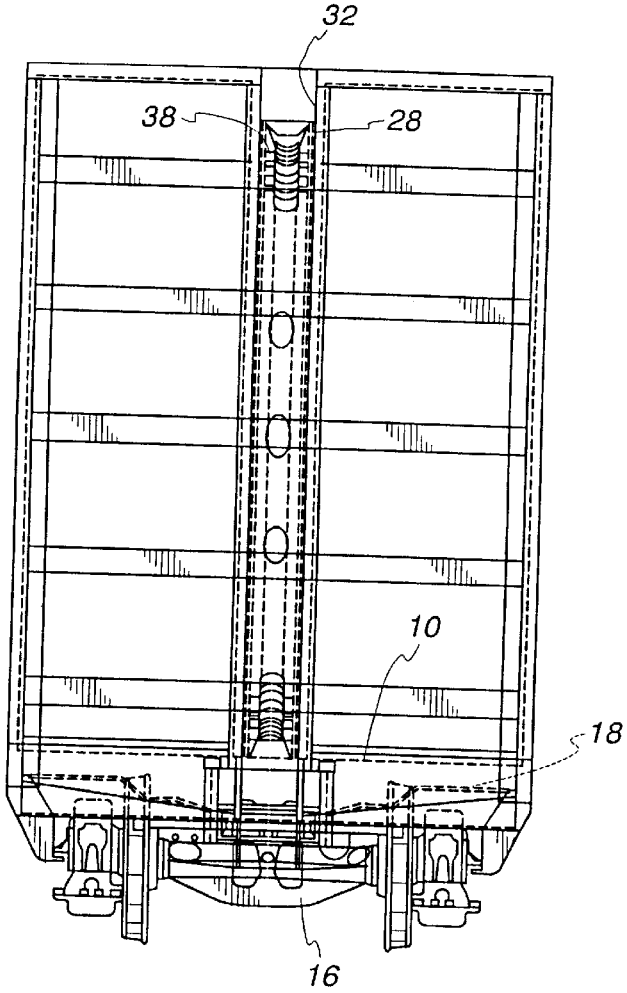
FIG. 10 is a schematic end elevational view of the railcar of FIG. 9.
Figure 11:
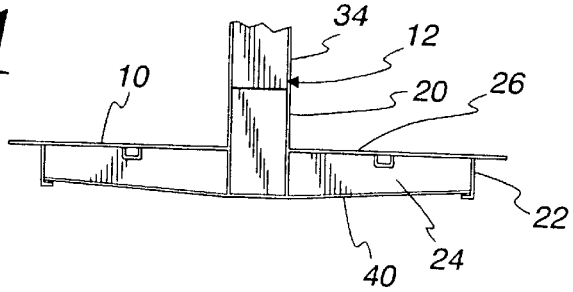
FIG. 11 is a schematic sectional view thereof, taken at the depressed deck.
Figure 12:
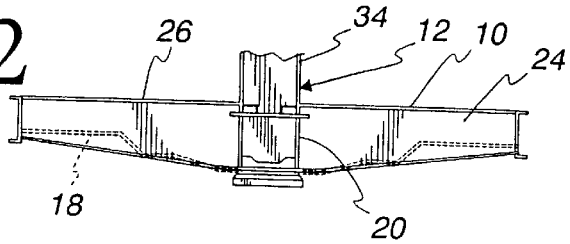
FIG. 12 is a schematic sectional view thereof, with a cross bearer at the upper deck shown in solid lines, and a section at the bolster shown in broken lines.

The center beam 12 preferably acts as a principal load-bearing structural support for the car to support the weight of the car and the lading. The center beam includes a top chord 32 that bears substantial compression loads. The top chord 32 is connected with the center sill by an intermediate structure that preferably comprises a plurality of vertical posts 34 and a plurality of diagonal braces 36. The vertical posts may be of Z-shaped cross-section, as shown in FIG. 3, or may be I-beams, as shown in FIG. 7, or may be of other configurations. The diagonal members 36 may be tubular, or may be of other configurations. The height of the center beam is preferably greater than or equal to that of the bulkheads.

To facilitate loading and unloading of the railcar using overhead cranes, and to facilitate loading of the car to a height above the bottom of the top chord 32, the top chord preferably is configured so as not to project beyond the sides of the intermediate structure immediately there beneath 38. Thus, the top chord in the preferred embodiment has a width that is about equal to or slightly less than the width of the adjacent intermediate structure. In the illustrated embodiment, the sides of the top chord are positioned slightly inward of the sides of the intermediate structure. This configuration may be contrasted with the configuration of center beam cars in the prior art wherein the top chords have projected outward from the surfaces therebelow. See, e.g., U.S. Pat. No. 3,244,120 and No. 3,734,031.

Notwithstanding its reduced width, the top chord 32 herein is one of the principal longitudinal load-bearing members of the car, and the superstructure of the center beam, i.e., the top chord 32, vertical posts 34 and diagonal braces 36, contribute substantially to the strength of the center beam, and thus to the weight-carrying capacity of the car. To provide the top chord with sufficient strength, stiffness and durability for long term usage in commercial rail transport, the top chord is preferably a tubular structure of generally square or other rectangular cross section.

To increase the volume of lading that can be accommodated by the railcar while maintaining versatility in accommodating ladings of various shapes and sizes, the deck preferably has a depressed center section or well 40 of sufficient length to accommodate large bundles of products, while leaving uninterrupted end portions 42 of substantial length that can also support large bundles of products. In one particular embodiment, the length between bulkheads 14 is 73 ft., and the length of the depressed center section 40 is 40 ft., leaving end sections 42 of about 16 ft. in length each. The 16 ft. end sections 42 may be used, e.g. for loading studs or other products having lengths of 8 ft. or 16 ft.

The width of the loading surface on each side of the center beam is about 4 ft.

The center section may be depressed by any desired dimension, subject to clearance limitations and other practical constraints. In some embodiments, the center section 40 is depressed 16 in. to accommodate bundles of engineered wood products having a height of 15½ in. In other embodiments, a 19 in. depression maybe employed. In still other embodiments, the depth of the depression is 30 in. Where products of varying densities are to be shipped, to facilitate maintaining a sufficiently low center of gravity for the car when fully loaded, products of higher density such as LVL may be loaded in the depression, with products of relatively lower density such as engineered wood products being loaded thereabove.

The depressed center section 40 and narrow top chord 32 combine to increase the clear loading height Preferably, the clear loading height is over 14 ft. These features not only make increased volume available for lading, but also enable the car to transport irregularly-shaped products that might be difficult or impossible to transport efficiently on earlier center beam cars.

In the preferred embodiment, the underframe and the posts 34 assist substantially in supporting the top chord 32 against buckling in the horizontal plane. Under static loading conditions when the car is fully loaded, the top chord 32 and diagonal braces 36 are loaded in compression, and the center sill 20 and posts 34 are loaded in tension. To reduce compression loads on the narrow top chord, the strength and stiffness of the posts may be increased by increasing the widths of their flanges 42, and the strength and stiffness of the diagonal braces 36 may similarly be increased. Also, the center sill 20 in the preferred embodiment has a fish belly configuration, wherein the center sill is relatively shallow adjacent the bolsters, but inward of the bolsters the bottom of the center sill slopes downward to provide the center sill with a deep central portion 42.

The unloaded car preferably has a weight not greater than about 70,000 lbs. In some embodiments, the weight of the car is about 64,000–66,000 lbs.

Preferably, the railcar is capable of carrying at least about 110 tons of wood products having a density of about 30 lbs. per cubic foot without exceeding the AAR Plate F clearances. The AAR Plate F clearance template is shown at 60.

Figure 1:
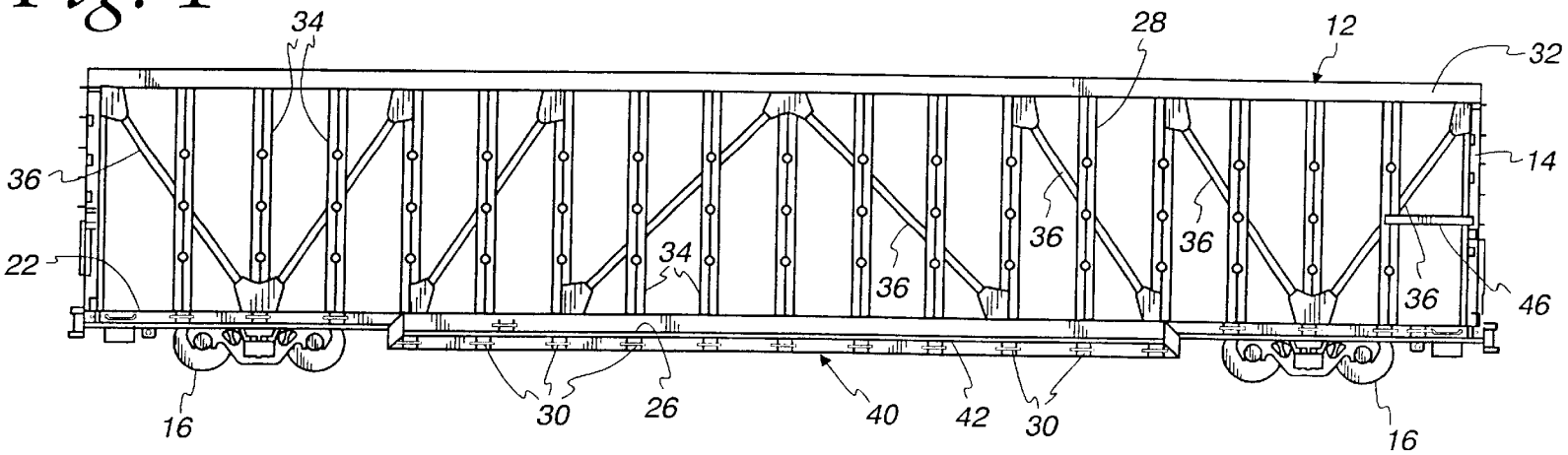
FIG. 1 is a side elevational view of a railcar in accordance with a first embodiment of the invention. A horizontal member connecting the bulkhead to the nearest vertical post at a position about half way up the bulkhead, shown at the right hand end of the car in FIG. 1, but not at the left hand of the car, may be included at both ends of the car.
Figure 2:
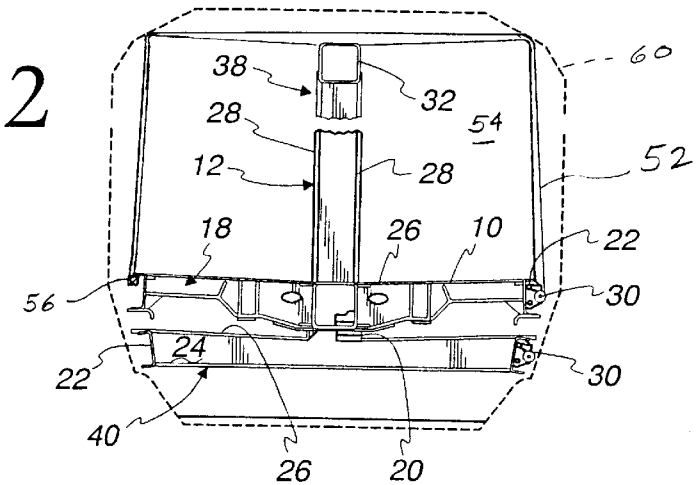
FIG. 2 is a schematic sectional end elevational view of the car of FIG. 1, shown on an enlarged scale, showing in cross-section the center beam, a bolster, and a cross bearer in a depressed deck portion.
Figure 6:
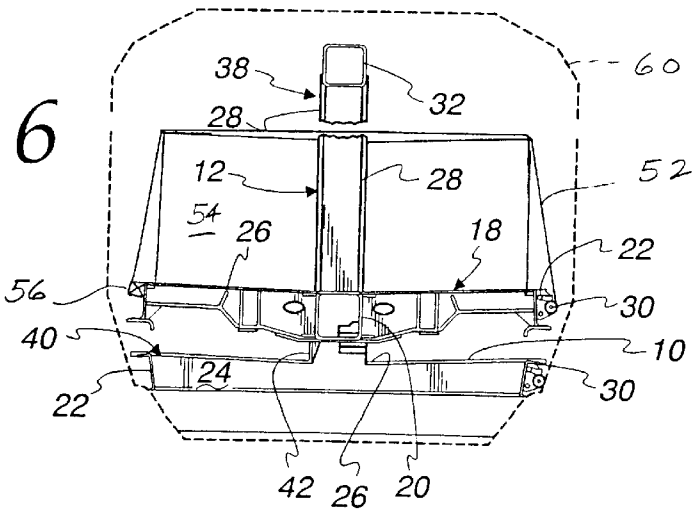
FIG. 6 is a schematic sectional end elevational view thereof, shown on an enlarged scale, illustrating in cross-section the center beam, a bolster, and a cross bearer in a depressed deck section.

The preferred mechanism for retaining lading on the railcar employs straps 52, rather than cables, and involves securement of the straps at low elevations on opposite sides of the railcar, with one end of each strap secured on one side at or near the side sill, and the other end of the strap secured on the other side of the railcar, at or near the side sill. As shown in FIG. 2, the strap 52 is passed over the lading 54 and, where the lading is stacked to the top chord 32, is passed over the top chord. Where the lading is not stacked to the height of the top chord, as in FIG. 6, the strap may be passed under the top chord to the other side of the railcar. The straps are preferably of a nonstandard width, e.g., 4½ in., to reduce the possibility of the straps being misappropriated for use in other applications.

Figure 5:
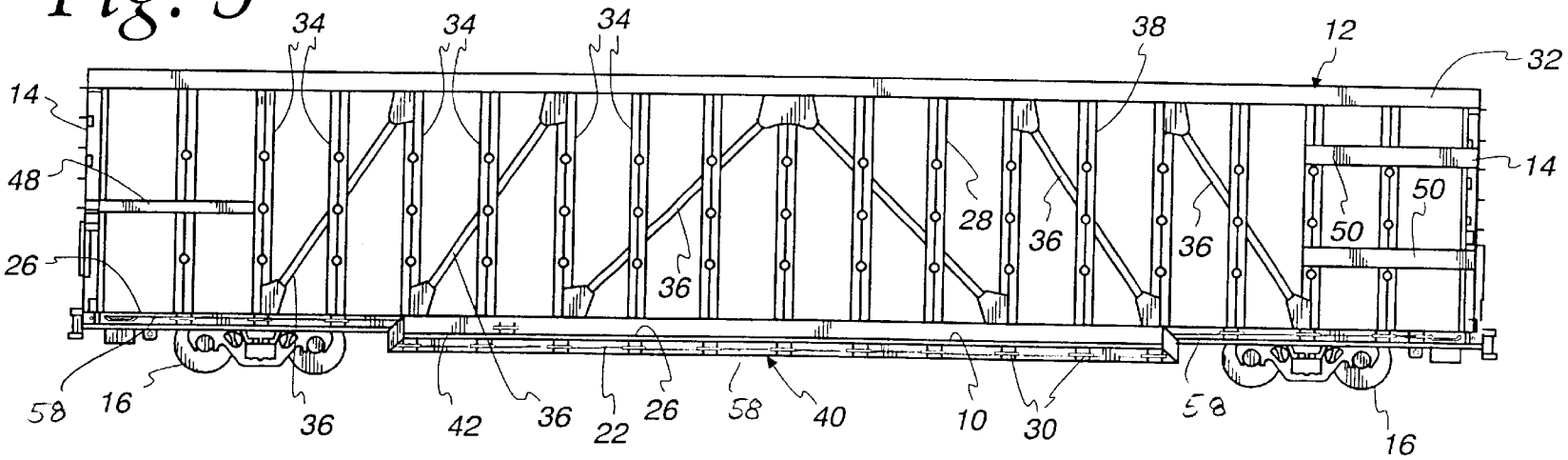
FIG. 5 is a side elevational view of a railcar in accordance with a second embodiment of the invention. Two alternative end structures are shown. At the left end, there is shown a single horizontal structural member connecting the bulkhead with the closest two vertical posts. At the right end, there are shown two horizontal structural members connecting the bulkhead with the closest two vertical posts. Either of these structures may be used at both ends of the railcar in the second embodiment of the invention.

Rather than including winches on both sides of the railcar as in the past, winches 30 are preferably provided on only one side, with one or more connecting mechanisms 56 provided on the other side to secure the free ends of the straps 52. The winches 30 and connecting mechanisms 56 are preferably longitudinally adjustable along tracks 58 (FIG. 5) so that the longitudinal positions of the straps may be adjusted to increase versatility in handling load components of various dimensions. To avoid requiring workers to be positioned on the railcar to secure and release the straps, the free end of the strap 52 may be thrown manually from one side of the car to the other. This may be accomplished by a worker standing facing away from the railcar, tossing the rolled up strap over his or her shoulder to the other side of the railcar. To facilitate this, a weight may be attached to the free end of the strap, or to a tether attached to the free end of the strap.

As an alternative, or in addition to the use of straps rather than cables, to protect corners of wood product loads, corner protectors may be included as integral parts of the wood product bundles.

In the embodiment of FIGS. 1–4, a diagonal brace 36 connects the top of the bulkhead 14 to the center sill 20. As shown at the right-hand end of the center beam in FIG. 1, an additional horizontal brace 46 may connect the bulkhead to the diagonal brace and/or to the nearest post 34. The horizontal brace 46 is positioned approximately halfway up the bulkhead.

In the embodiment of FIGS. 5–8, at the ends of the center beam 12, one or more structural members may connect the bulkhead with one or more posts 34, without being connected to the center sill 20 or to the top chord 32, and without any of the diagonal members 36 being attached to the bulkhead. In the arrangement shown at the left in FIG. 5, a single horizontal member 48 is connected to the bulkhead 14 and to each of the two posts 38 closest to that bulkhead, about midway between the top chord and the center sill, without being connecting to the center sill or to the top chord. In another arrangement, shown at the right in FIG. 5, two horizontal structural supports 50 are connected to each bulkhead 14, and to the two posts 34 closest to that bulkhead, without being connected to the center sill or to the top chord. The two horizontal supports may be spaced at about ⅓ and ⅔ of the height of the center beam.

From the foregoing, it should be appreciated that the invention provides a novel and improved center beam car. The invention is not limited to the embodiments described above and shown in the accompanying drawings, nor to any particular embodiments. The invention is particularly pointed out and further described in the following claims.

What is claimed:

1. A method of securing a load on a center beam railcar comprising:

providing a strap on a first side of the railcar and retaining a first end of said strap on said first side;

providing a fastener on the opposite side of said railcar;

passing a second end of the strap over the load and over a top chord of the railcar to the other side of the railcar while retaining the first end of the strap on said first side;

securing the second end of the strap to the second side of the railcar with said fastener; and tensioning the strap.

2. The method of claim 1 wherein tensioning the strap comprises winding the strap onto a winch, said method further comprising adjusting the longitudinal position of at least one end of said strap by adjusting the longitudinal position of at least one of said winch and said fastener.

3. A method of securing a load on a center beam railcar comprising:

providing a strap on a first side of the railcar and retaining a first end of said strap on said first side;

passing a second end of the strap over the load and under a top chord of the railcar to the other side of the railcar while retaining the first end of the strap on said first side;

securing the second end of the strap to the second side of the railcar; and tensioning the strap.

4. A method of retaining lading on a center beam railcar, comprising:

securing one end of at least one strap on one side of the railcar, at or near a side sill;

passing said at least one strap over the lading and, if the lading is stacked to a top chord of the railcar, passing the strap over the top chord, and if the lading is not stacked to the height of the top chord, passing the strap under the top chord, to the opposite side of the railcar; and securing the other end of said at least one strap to the other side of the railcar at or near a side sill on the opposite side of the railcar.

5. The method of claim 4 wherein said railcar includes a deck, bulkheads at opposite ends of the railcar, and a center beam comprising a center sill, a top chord positioned at approximately the same height as the top of each bulkhead, and an intermediate structure therebetween, said top chord being free of any structure protruding substantially beyond the width of said intermediate structure, and wherein said deck has a depressed central portion, said railcar having a clear loading height of at least 14 feet above said depressed central portion.

* * * * *